US006057659A

United States Patent [19]

Akiyama et al.

[11] Patent Number: 6,057,659

[45] Date of Patent: May 2, 2000

[54] SPEAKER APPARATUS

[75] Inventors: Akihiro Akiyama, Kanagawa; Makoto Yamagishi, Tokyo; Naoki Watanabe, Kanagawa, all of Japan

[73] Assignee: Sony Corporation, Tokyo, Japan

[21] Appl. No.: 09/003,439

[22] Filed: Jan. 6, 1998

[30] Foreign Application Priority Data

Jan. 9, 1997 [JP] Japan ..... P09-002472

[51] Int. Cl.[7] ..... H04R 25/00

[52] U.S. Cl. ..... 318/386; 381/387; 181/144; 181/147

[58] Field of Search ..... 312/320; 381/387, 381/102, 186, 181, 86, 300, 389, 386, 326; 181/31, 148, 160, 164, 159, 147, 199, 144, 145

[56] References Cited

U.S. PATENT DOCUMENTS

| | | | |
|---|---|---|---|
| 3,680,936 | 8/1972 | Backhaus | 312/7 |
| 5,675,426 | 10/1997 | Meisner et al. | 358/838 |
| 5,802,194 | 9/1998 | Yamagishi et al. | 381/188 |

*Primary Examiner*—Wing F. Chan
*Assistant Examiner*—Dionne N. Harvey
*Attorney, Agent, or Firm*—Jay H. Maioli

[57] ABSTRACT

A miniaturized speaker apparatus including a cabinet to which a first speaker unit for reproducing a low frequency range is installed; second speaker units for reproducing a medium frequency range and/or a high frequency range; and supporting members for supporting the second speaker units on their tip end sides, the supporting members being supported by the cabinet so as to rotatably move between a first position, where the second speaker units are spaced apart from the cabinet, and a second position, where the second speaker units are positioned on the cabinet side making the speaker apparatus convenient for carrying.

4 Claims, 10 Drawing Sheets

SPEAKER APPARATUS

BACKGROUND OF THE INVENTION

1. Field of the Invention

The present invention relates to a speaker apparatus equipped with a first speaker unit for reproducing a low frequency range, and a second speaker unit for reproducing a medium frequency range and/or a high frequency range, and more particularly to a speaker apparatus capable of positioning the second speaker unit apart from a cabinet with the first speaker unit installed thereto.

2. Description of Related Art

As the speaker apparatus, conventionally there has widely been used a speaker apparatus, in which a first speaker unit 1 for reproducing a low frequency range and a second speaker unit 2 for reproducing a medium frequency range to a high frequency range are housed in a cabinet 3 common thereto as shown in FIG. 12. In this speaker apparatus, the first and second speaker units 1 and 2 are in parallel installed to a baffle plate 4 constituting the front plate of the cabinet 3.

When the first and second speaker units 1 and 2 are thus installed through the baffle plate 4, a part of reproduced sound emitted from the first and second speaker units 1 and 2 is reflected by the baffle plate 4. The reflected wave reflected by the baffle plate 4 is superposed on reproduced sound emitted on the front side of the first and second speaker units 1 and 2, whereby the reflected wave interferes with this reproduced sound to deteriorate the sound pressure reproducing characteristics.

When the first and second speaker units 1 and 2 are installed to the baffle plate 4, the sound emitted from the first and second speaker units 1 and 2 forms a sound field which spreads in the front of the baffle plate 4 so that a good sound field having a three-dimensional spread cannot be obtained.

In addition, in the case of stereophonic sound reproduction, two cabinets consisting of a cabinet 3 for left channel sound and a cabinet 3 for right channel sound are required, and it is inconvenient to carry them.

As a speaker apparatus for preventing the deteriorated sound pressure frequency characteristics caused by installation of speaker units on a baffle plate, and realizing a sound field spreading in three-dimensional directions and reproduction of sound excellent in presence, and yet capable of stereophonic reproduction with a single speaker apparatus, there is Japanese Patent Laid-Open Application No. 7-107585 filed by the present applicant in Japan.

The speaker apparatus described in this official gazette is constructed so that a pair of speaker units for reproducing medium and high frequency ranges are caused to float in the air. More specifically, this speaker apparatus is obtained by connecting a pair of speaker units for reproducing middle and high frequency ranges to a substantially cylindrical, tightly closed cabinet in which a speaker unit for reproducing a low frequency range is housed, through a supporting arm with a small diameter. The sound emitted from a speaker unit supported so as to be caused to float in the air through the supporting arm in this way is emitted around the speaker unit without being affected by the baffle plate, thus forming a sound field excellent in presence, having a three-dimensional spread without deteriorating the sound pressure frequency characteristics.

The speaker apparatus described in the official gazette is constructed to be installed at a predetermined place for use, and therefore, two mid end high-range speaker units supported on the tip end portions of respective supporting arms are installed to the cabinet through an oscillating mechanism respectively so that the spacing between these speaker units can be widened or narrowed. The respective supporting arms and speaker units are always placed in a state in which they project from the cabinet. The center-to-center spacing between the two mid and high-range speaker units is about 300 mm when narrowed most, and is about 700 mm when widened most.

A speaker apparatus is provided which is used by connecting it to an acoustic apparatus such as a portable tape recorder and a CD player through a connect cord. This type of speaker apparatus is carried, for use, together with a portable acoustic apparatus to which this speaker apparatus is connected.

If the speaker apparatus described in the official gazette applies as a portable speaker apparatus, the speaker unit supported through the supporting arm so that it projects from the apparatus body, makes the occupied area of the apparatus itself larger, and it becomes inconvenient to carry it. Also, the speaker unit projected from the apparatus body is very likely to be easily damaged during carrying.

It is an object of the present invention to provide a speaker apparatus excellent in the portability, and in the presence, for realizing good sound pressure frequency characteristics.

It is another object of the present invention to provide a speaker apparatus capable of reliably protecting a speaker unit which projects from the cabinet to be used.

SUMMARY OF THE INVENTION

In order to achieve the object as described above, a speaker apparatus according to the present invention is constructed to make a second speaker unit supported so as to project through the supporting arm from a cabinet, to which a first speaker unit for reproducing the low frequency range is installed, movable to a housing position on the cabinet side.

More concretely, the supporting member for supporting the second speaker unit is supported on the cabinet so as to rotate over between a first position where the second speaker unit is spaced apart from the cabinet and a second position where the second speaker unit is positioned on the cabinet side.

Further, when the supporting member is rotated at the second position where the second speaker unit is positioned on the cabinet side, design is made such that the speaker unit supported on the side of the tip end of the supporting member is housed in a housing concave portion provided in the cabinet.

BRIEF DESCRIPTION OF THE DRAWINGS

FIG. 8 is a block diagram of the electronic circuits of a speaker apparatus according to the present invention;

DETAILED DESCRIPTION OF PREFERRED EMBODIMENTS

Hereinafter, with reference to the accompanying drawings, the description will be made of embodiments of a speaker apparatus according to the present invention.

Figure 1:
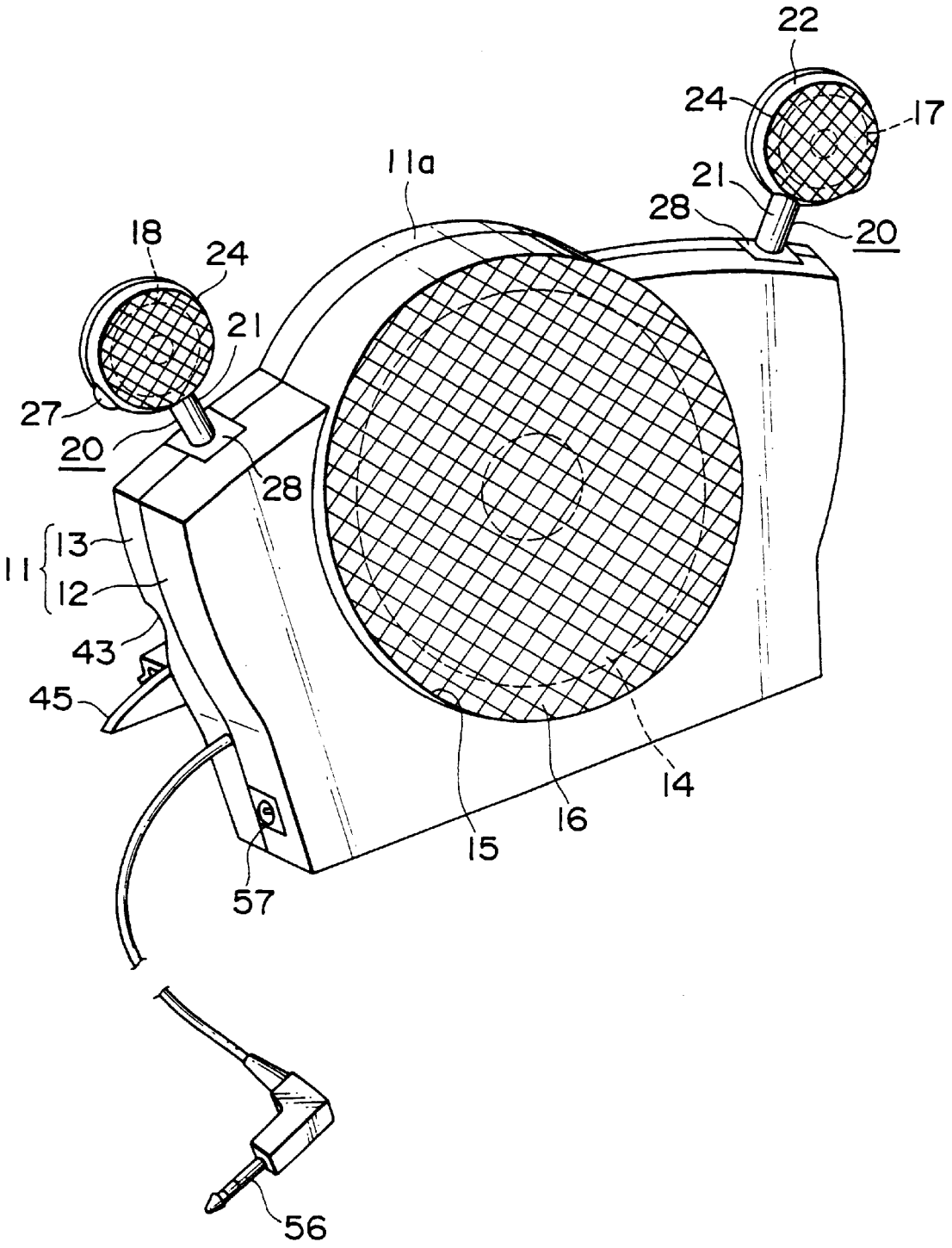
FIG. 1 is a perspective view, as viewed from the front side, showing a speaker apparatus according to the present invention.
Figure 2:
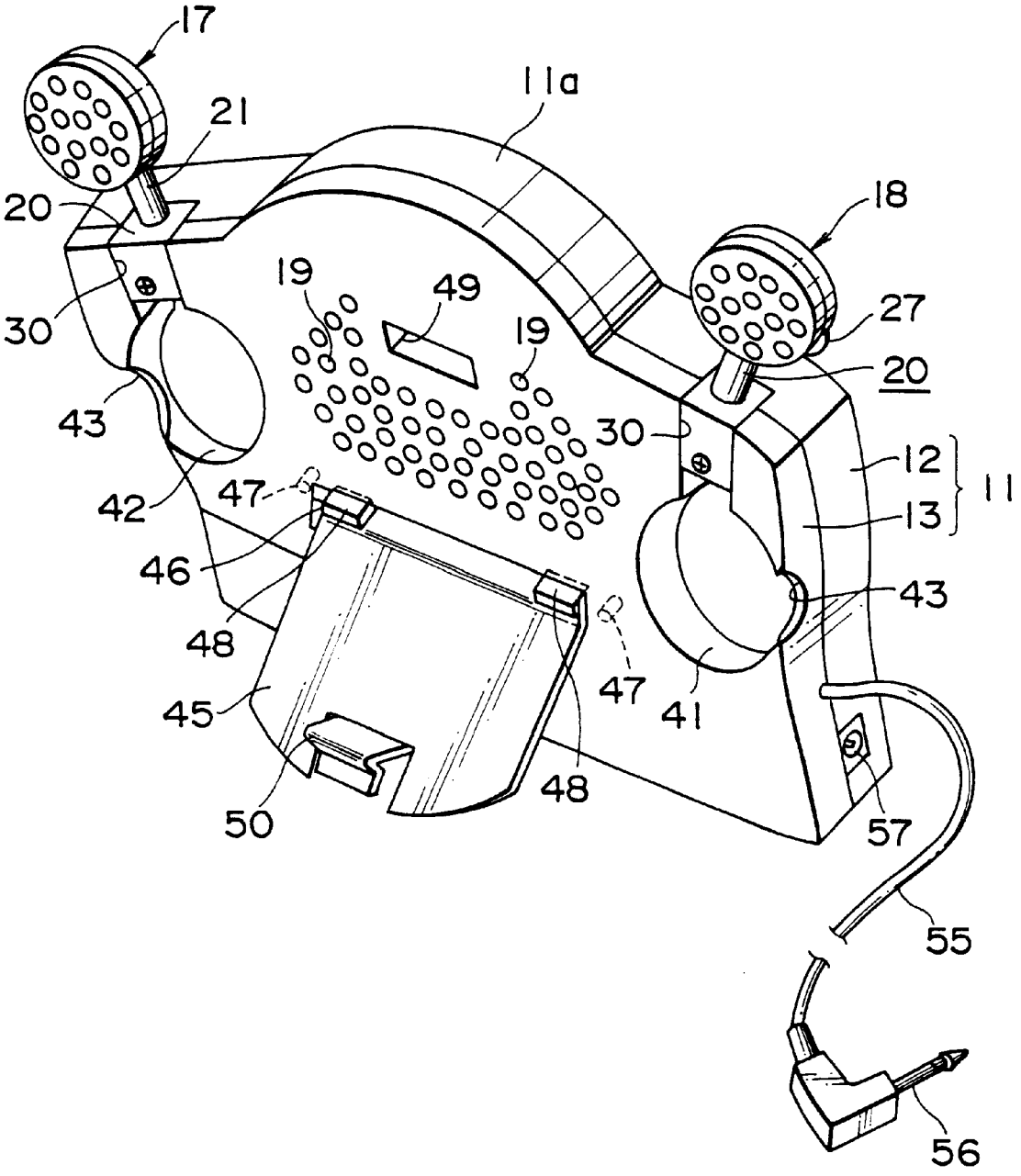
FIG. 2 is a perspective view showing the back side of the speaker apparatus.

A speaker apparatus according to the present invention has a cabinet 11 constituting the apparatus body as shown in FIGS. 1 and 2. This cabinet 11 is formed by butting and joining a pair of front side half 12 and back side half 13 which have been formed by forming synthetic resin.

In the cabinet 11, there is housed a first speaker unit 14, which is a woofer unit for reproducing audio signals having a frequency band of 50 Hz to 3 kHz or 4 Hz of the approximate low frequency range. This speaker unit has a diameter of 65 mm. The first speaker unit 14 is installed within the cabinet 11 with a diaphragm facing a circular opening 15 formed on the front side of the cabinet 11. On the opening 15 of the cabinet 11 which the diaphragm of the first speaker unit 14 faces, there is installed a front grille 16 formed by a metal plate provided with a plurality of fine holes. This front grille 16 is used to protect the diaphragm while transmitting the reproduced sound emitted from the diaphragm of the speaker unit 14. On the back side of the cabinet 11, a plurality of through-holes 19 are provided as shown in FIG. 2. These through-holes 19 are used to emit the reproduced sound emitted from the back side of the first speaker unit 14 outside of the cabinet 11. In other words, this cabinet 11 is formed so as to constitute a back face open type speaker for the first speaker unit 14.

In addition, within the cabinet 11, there is arranged a printed circuit board in which there are constituted a speaker driving circuit and a power circuit such as an amplifier circuit for amplifying audio signals supplied to the first speaker unit 14 and a pair of second speaker units 17 and 18 to be described later.

In this respect, in the central portion of the cabinet 11 on the top end side, there is formed a raised portion 11*a* of a circular arc shape correspondingly to the outer peripheral shape of the first speaker unit 14, which is circular, housed in the cabinet 11.

There are rotatably mounted a pair of supporting members 20 and 20, which are located on both sides and on the top side of the cabinet 11 for housing the first speaker unit 14, and, in which a pair of: the second speaker units 17 and 18 are mounted on the tip end side thereof respectively as shown in FIGS. 1 and 2. These supporting members 20 and 20 cause the pair of second speaker units 17 and 18 supported on the tip end side to be apart from the cabinet 11 in a state in which they are rotated from the cabinet 11 side to rise, and to be supported at the first position. The pair of second speaker units 17 and 18 are thus supported at a position apart from the cabinet 11, whereby the reproduced sound emitted from the pair of second speaker units 17 and 18 is emitted without being reflected by the baffle plate or the like, and therefore, becomes excellent in the sound pressure reproduction characteristics and in the presence without being affected by the reflected wave. In this respect, the diameters of the pair of second speaker units are 16 mm respectively.

The second speaker units 17 and 18 installed on the tipend side of each supporting member 20, 20 reproduce audio signals of the right and left channels respectively during stereophonic sound reproduction. The second speaker units 17 and 18 reproduce audio signals within a frequency band of 3 kHz or more.

The supporting members 20 and 20 for supporting the second speaker units 17 and 18 will be described. In this respect, the supporting members 20 and 20 for supporting the pair of second speaker units 17 and 18 respectively are bisymmetrically formed and have the same structure, and only the supporting member for supporting the left channel speaker unit 18 will be described.

Figure 3:
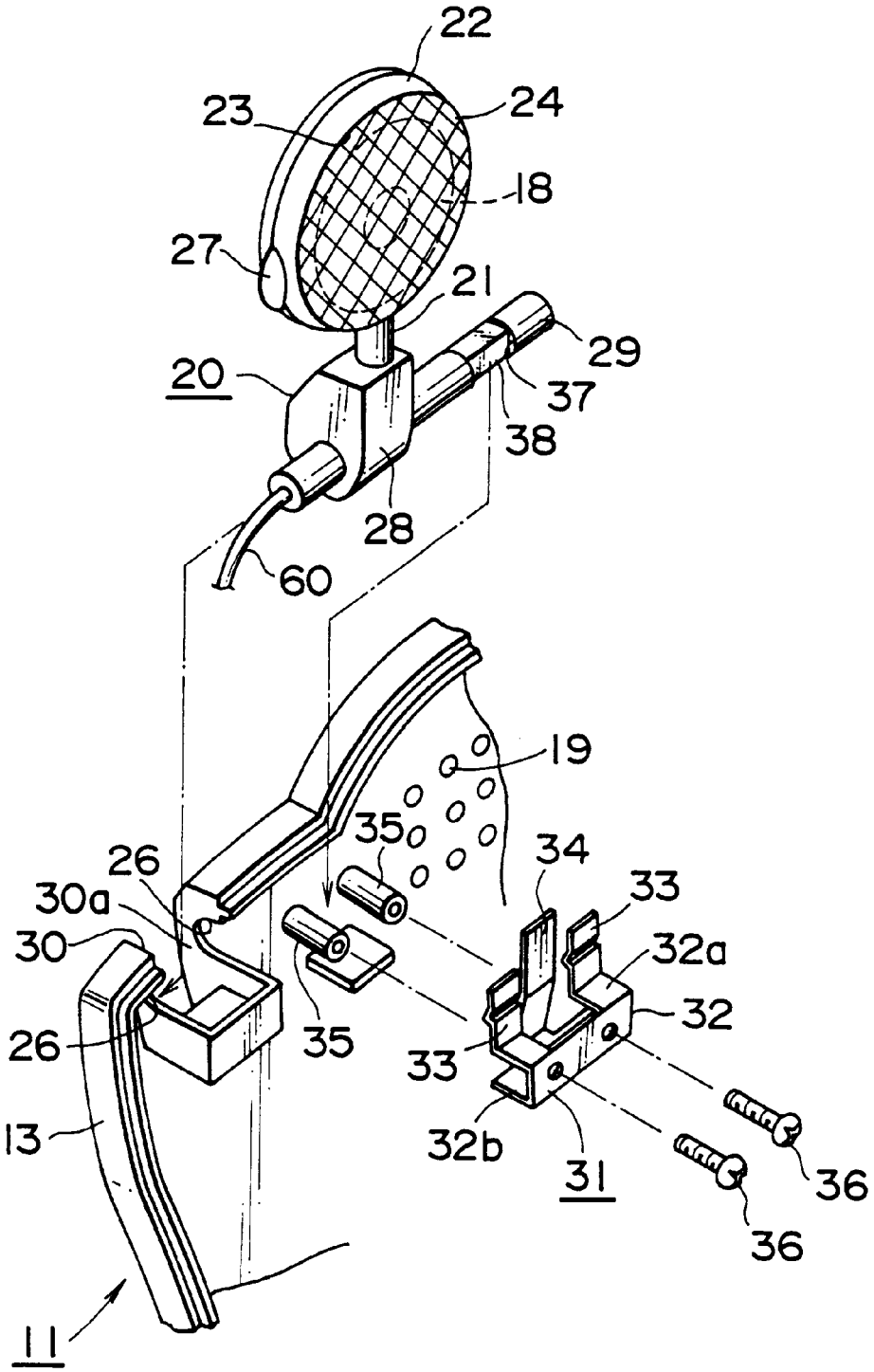
FIG. 3 is a perspective view showing a state in which a supporting member for supporting a second speaker unit is installed to the cabinet as viewed from the front side.
Figure 4:
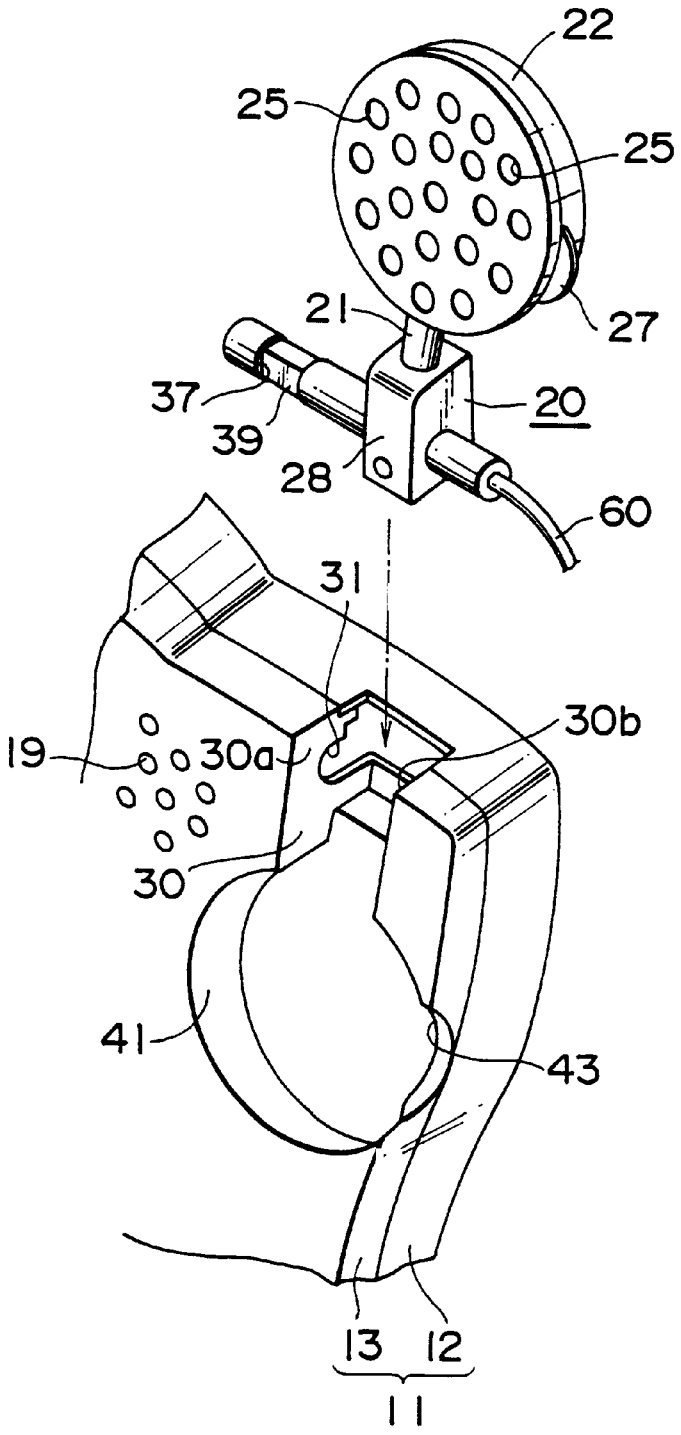
FIG. 4 is a perspective view showing a state in which the supporting member is installed to the cabinet as viewed from the back side.

The supporting member 20 has a small, cylindrical supporting arm 21 as shown in FIGS. 3 and 4, on the tip end side of which, a housing member 22 for housing the left speaker unit, i.e., the second speaker unit 18 is provided.

This housing member 22 is formed to the minimum size sufficient to house the second speaker unit 18 formed into a substantially circular shape. The second speaker unit 18 is installed within the housing member 22 with a diaphragm facing a circular opening portion 23 formed on the front side of the housing member 22. At the opening portion 23 of the housing member 22, which the diaphragm for the second speaker unit 18 faces, there is installed a front grille 24 formed by a metal plate provided with a plurality of fine holes. In addition, a plurality of fine through-holes 25 are provided on the back side of the housing member 22 so that a back face open type speaker is constituted for the second speaker unit 18. Accordingly, when the second speaker unit 18 housed in this housing member 22 is driven, design is made such that the sound is emitted from the front side of the housing member 22 and the reproduced sound is also emitted from the back side. Lead wire 60 connected to the second speaker unit 18 housed in the housing member 22 is inserted into the supporting arm 21 and is drawn out from the proximal end side of the supporting member 20 outside of the supporting member 20.

On the outer periphery of the housing member 22, there is projectedly provided a finger grip 27 for putting the hand or finger on it when rotationally operating the supporting member 20.

On the proximal end side of the supporting member 20, there is provided a rotary guide block 28 as shown in FIGS. 3 and 4, and there is mounted a cylindrical rotation shaft 29 extended in a direction perpendicular to the axial direction of the supporting arm 21 so as to extend through this rotary guide block 28.

The supporting member 20 for supporting the second speaker unit 18 on the tip end side as described above is caused to fit in a fitting concave portion 30 provided at the corner portion of the cabinet 11 on the top end side, the rotation shaft 29 is inserted through through-holes 26 and 26 formed in side walls 30*a* and 30*b* which face to each other in the fitting concave portion 30 to project in the cabinet 11, and is thus installed to the cabinet 11. One end portion of the rotation shaft 29, which projects in the cabinet 11, is pressed and supported by a pressing supporting member 31 arranged in the cabinet 11, which has been formed by bending a metallic blade spring. This pressing supporting member 31 urges the rotation shaft 29 against the cabinet 11 to thereby position a mounting position of the supporting member 20 to the cabinet 11 and to rotatably support.

The pressing supporting member 31 has a pair of pressing pieces 33 and 33 projectedly provided upwardly from the left side and the right side of the tip end of an upper piece 32*a* of a mounting portion 32 obtained by bending in a letter shape, and a pressing supporting piece 34 projectedly provided upwardly from the tip end side of a lower piece 32*b* of the mounting portion 32, located between the pair of pressing pieces 33 and 33 as shown in FIG. 3. In this respect, the pair of pressing pieces 33 and 33 and the pressing supporting piece 34 are projectedly provided with different project heights from each piece 32*a* and 32*b* respectively.

In the pressing supporting member 31, the pair of pressing pieces 33 and 33 and the pressing supporting piece 34 are caused to extend on the rotation shaft 29, and the mounting portion 32 is mounted to a pair of boss portions 35 and 35 which have been inlaid on the inner surface of the housing 11 through fixing screws. The pressing supporting member 31 is mounted to the boss portions 35 and 35 whereby the pair of pressing pieces 33 and 33 press on the outer peripheral surface of the rotation shaft 29. The pressing supporting piece 34 engages with an engaging concave portion 37 having a rectangular cross section which has been formed by cutting out the outer peripheral surface of the rotation shaft 29 to press on the rotation shaft 29.

On the base portion of the engaging concave portion 37 with which the pressing supporting piece 34 engages, there are provided a pair of first and second pressed surfaces 38 and 39, which have been formed as flat surfaces substantially in parallel with each other and, which are sides opposite to each other. The pressing supporting piece 34 presses and supports the first or second pressed surface 38 or 39 depending on the rotation position of the supporting member 20 to thereby hold the supporting member 20 at the respective rotation position.

When the supporting member 20 has been rotated to a first position where it is projected from the cabinet 11 as shown in FIGS. 1 and 2, the pressing supporting member 34 presses on the first pressed surface 38 to hold the supporting member 20 at the first position. When the supporting member 20 is rotated by 180° and is positioned at the second position on the cabinet 11 side as shown in FIGS. 5 and 6, the pressing supporting piece 34 presses on the second pressed surface 39 to hold the supporting member 20 at the second position.

The rotation shaft 29 is thus provided with the first and second pressed surfaces 38 and 39, and the supporting member 20 is rotatably mounted to the cabinet 11 in such a manner that these first and second pressed surfaces 38 and 39 are pressed and supported by the pressing supporting piece 34 of the pressing supporting member 31. Thus, the supporting member 20 is rotationally held so that a feeling of click can be obtained between the first position and the second position.

Figure 5:
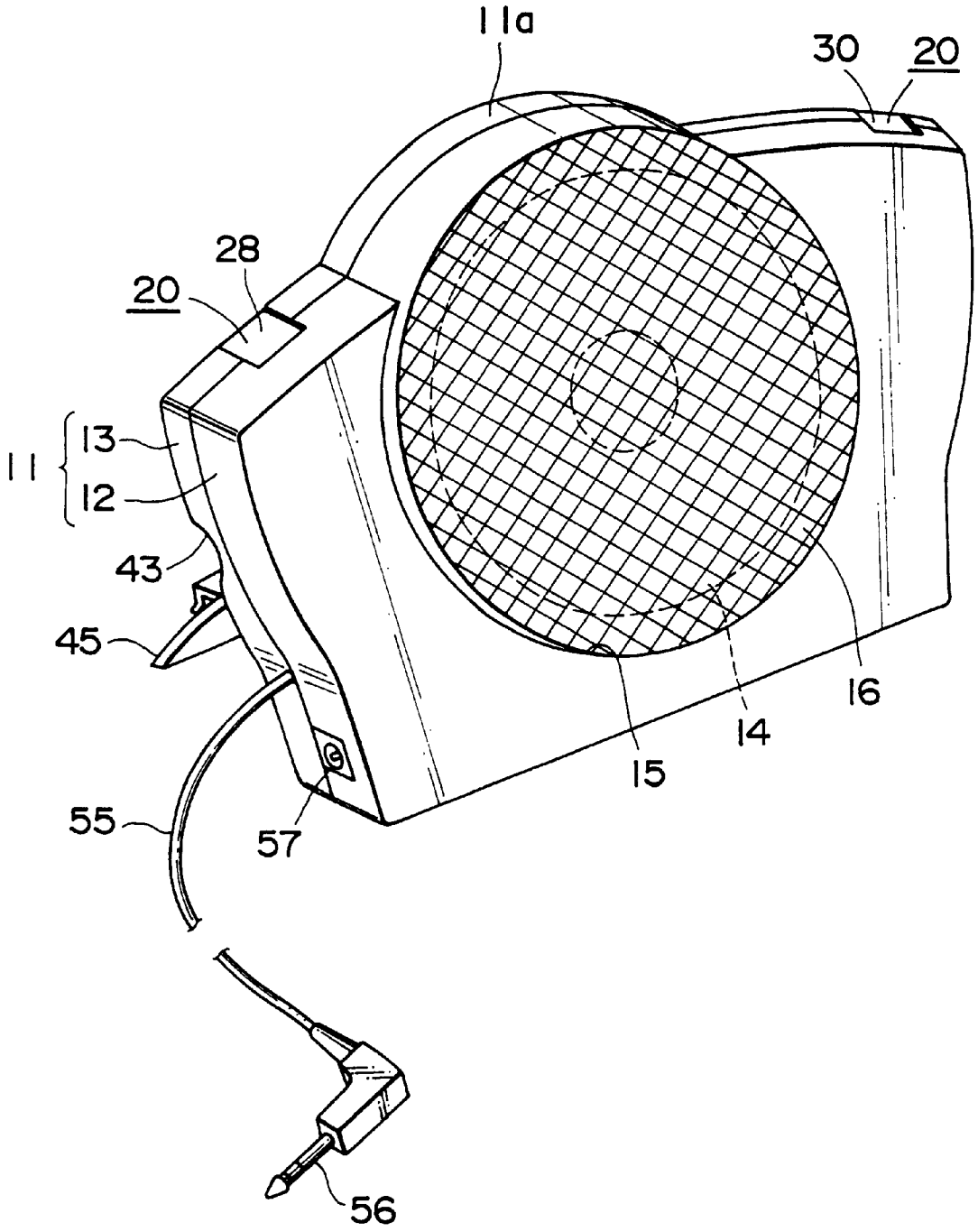
FIG. 5 is a perspective view showing a state in which the second speaker unit is housed in the cabinet as viewed from the front side.
Figure 6:
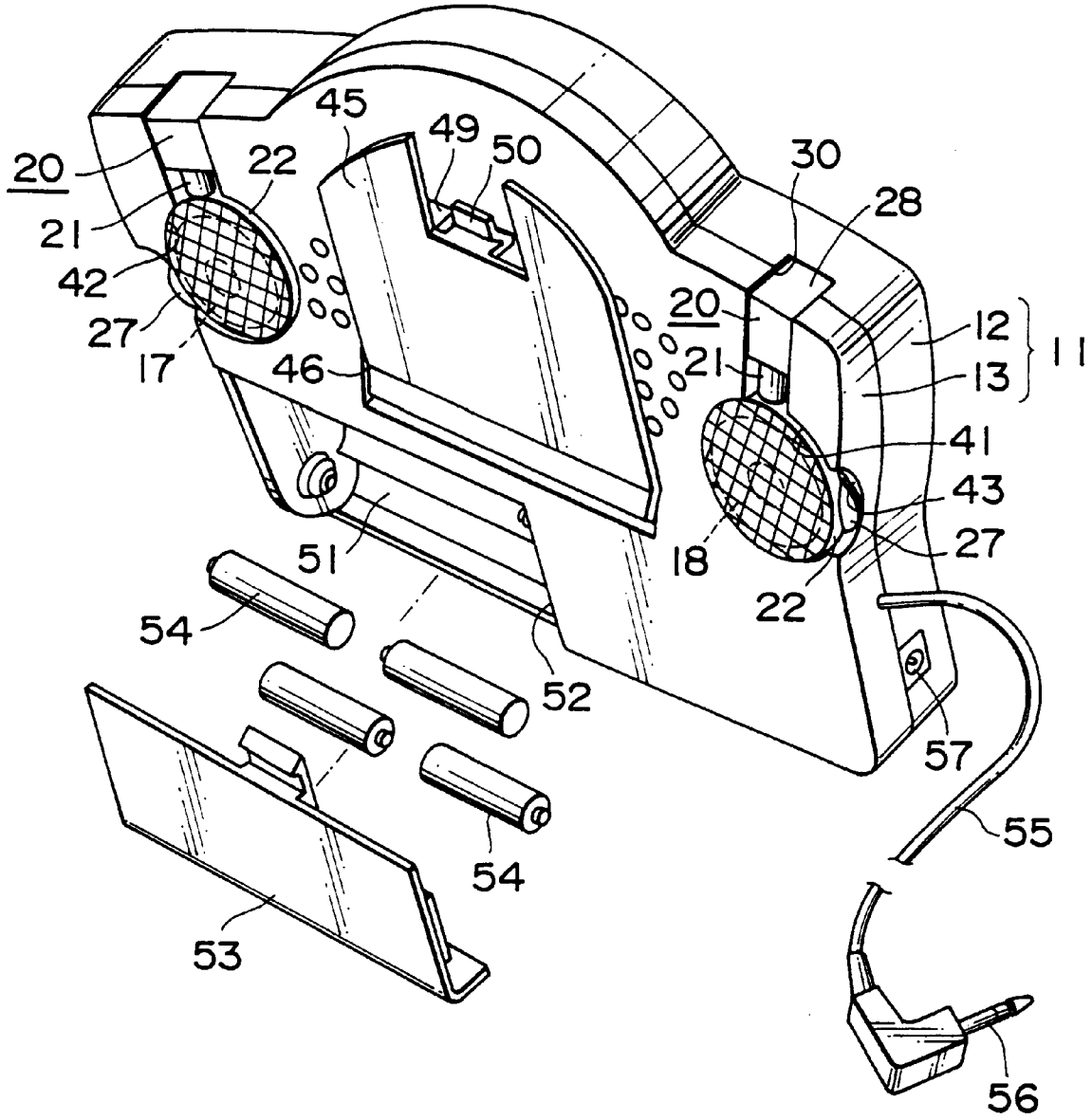
FIG. 6 is a perspective view showing a state in which the second speaker unit is housed in the cabinet as viewed from the back side.

In the vicinity of each corner of the cabinet 11 on the back side and on the top side, there is provided a housing concave portion 41 or 42 for housing a housing member 22 provided on the tip end side of the supporting member 20 when the supporting member 20 has been rotated to the second position where it is positioned on the cabinet 11 side as shown in FIGS. 5 and 6. This housing concave portion 41 is formed so as to be continuous to the fitting concave portion 30 in which the rotary guide block 28 on the proximal end side of the supporting member 20 is fitted as shown in FIGS. 2 and 4. The housing concave portion 41 is formed to such depth that the housing member 22 can be housed so that it is substantially flush with the surface of the cabinet 11.

On a part of the housing concave portion 41, there is provided a finger grip concave portion 43 in which the finger grip 27 provided on the housing member 22 is located. In this finger grip concave portion 43, the finger grip 27 of the housing member 22 housed in the housing concave portion 41 is caused to face outward from the side of the cabinet 11 as shown in FIG. 6 by opening the side of the cabinet 11. Accordingly, it is possible to put the hand or finger on the finger grip 27 of the housing member 22 housed in the housing concave portion 41 or 42 so that it is laid underground in the housing concave portion 41 or 42, from the side of the cabinet 11. It is also possible to easily perform such an rotary operation as to cause the supporting member 20 to rise from the cabinet 11. In this respect, the description has made of the support of the left speaker unit 18 of the second speaker and the housing in the housing concave portion 41, but since the support of the right speaker unit 17 and the housing in the housing concave portion 42 are only bisymmetrical to the structure of the speaker unit 18, the detailed description is omitted.

The center-to-center spacing between the right speaker unit 17 and the left speaker unit 18, each of which is the second speaker unit, is 140 mm when they are spaced apart from the cabinet 11 (first position).

As described above, in a speaker apparatus according to the present invention, the supporting members 20 and 20 for supporting the second speaker units 17 and 18, which project from the cabinet 11, can be housed on the back side thereof as shown in FIGS. 5 and 6.

In a speaker apparatus according to the present invention, in order to independently set it up at a predetermined installation place, the back side of the cabinet 11 is fitted with a leg piece 45 made of synthetic resin as shown in FIGS. 2 and 6. This leg piece 45 is formed in a wide flat plate shape. Its proximal end side is inserted into a fitting concave portion 46 provided on the back side of the cabinet 11, and shafts 47 and 47 projectedly provided on both sides of the proximal end side are caused to be pivotally supported by pivotal supporting holes provided on the inner sides of the fitting concave portion 46, which face to each other, whereby the leg piece 45 is rotatably supported by the cabinet 11. The leg piece 45 is rotated over between a leg-opening position where it extends obliquely downward with respect to the cabinet 11 as shown in FIG. 2, and a leg-closing position shown in FIG. 6 where it extends along the back of the cabinet 11.

On the upper edge side of the fitting concave portion 46, there is provided a projecting piece 48 for regulating the rotation position of the Leg piece 45 with respect to the cabinet 11 by engaging with the proximal end side of the leg piece 45 when the leg piece 45 has been rotated to the leg-opening position. The provision of such a projecting piece 48 maintains the leg piece 45 at a fixed leg-opening position. Since the leg-opening position of the leg piece 45 is regulated at the fixed position, the cabinet 11 can be installed at a fixed angle to the ground plane as shown in FIG. 7 when the leg piece 45 is opened and installed at a predetermined installation place.

On the tip end side of the leg piece 45, there is provided an engaging portion 50 for engaging with an engaging concave portion 49 provided on the back of the cabinet 11 to hold the leg piece 45 at the leg-closing position when the leg piece 45 has been rotated to the leg-closing position. Thus, the provision of the engaging portion 50 for engaging with the engaging concave portion 49 provided on the cabinet 11 side enables the leg piece 45 to be reliably maintained at the leg-closing position. On the back side of the cabinet 11, there is provided a cell housing portion 51 for housing a cell 54 for supplying power supply for driving the first and second speaker units 14 and 17, 18 as shown in FIGS. 2 and 6. This cell housing portion 51 is provided with an opening portion 52 for mounting and demounting the cell on the back side of the cabinet 11. This opening portion 52 is closed by a lid 53 made of synthetic resin which can be engaged with or disengaged from the cell housing portion 51.

Figure 7:
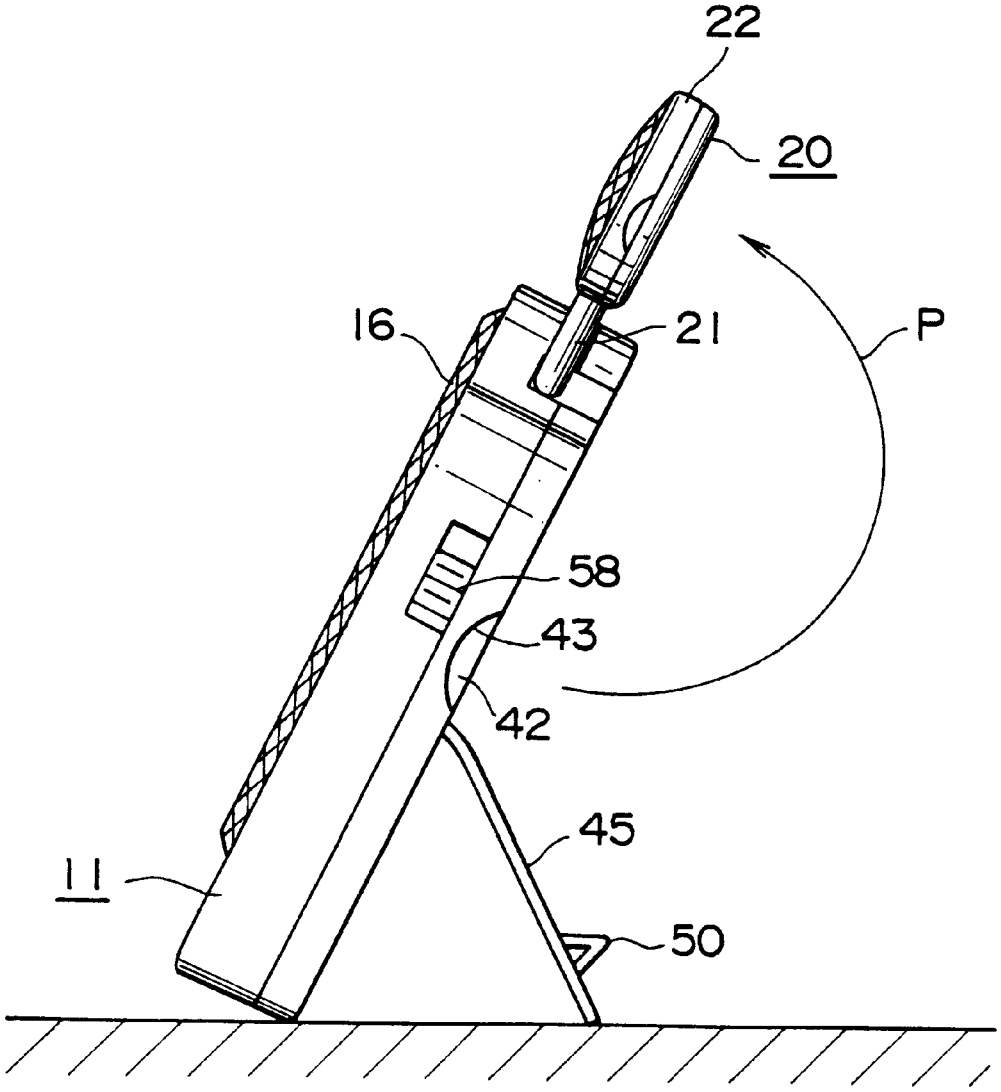
FIG. 7 is a side view showing a state of use for a speaker apparatus according to the present invention.

In this respect, on the right side of the cabinet 11, there is provided a switch button 58 for switching ON/OFF the power switch as shown in FIG. 7.

From this speaker apparatus, an external connecting cord 55 for connecting to an acoustic apparatus such as a portable tape recorder or a CD player is drawn out. This external connecting cord 55 is drawn out from one side of the cabinet 11 as shown in FIGS. 1 and 2. At the tip end of the connecting cord 55, there is fitted a connecting plug 56 which is electrically connected to the connecting terminal of the acoustic apparatus. An audio signal from the acoustic apparatus is supplied to an acoustic circuit within the speaker apparatus through the external connecting cord 55.

In the vicinity of the external connecting cord 55 drawn out from the cabinet 11, there is provided a connecting terminal 57, to which the power cord of an AC adapter for supplying power supply to this speaker apparatus from the commercial power supply (AC) is connected as shown in FIG. 2.

With the above-described structure, when the supporting members 20 and 20 for supporting the pair of second speaker units 17 and 18 respectively are placed at the second position where they are housed on the back side of the cabinet, with the leg piece 45 at the leg-closing position, the size of the cabinet is 145 mm (maximum width) ×110 mm (maximum height) ×35 mm (maximum depth); the entire speaker apparatus has a size enough to hold it within the palm of the hand and is easy to carry.

In this respect, the maximum width and height of this cabinet 11 can be made 10 mm to 20 mm smaller or larger than the above-described sizes if necessary. In addition, the center-to-center spacing between the right speaker unit 17 and the left speaker unit 18, which are the second speaker units, in a first-position state can be selected within a range of 120 mm to 200 mm. If this distance is made to be shorter than 120 mm (spacing between left and right ears of children), it becomes difficult to obtain a feeling of spread of the left and right sound during stereophonic sound reproduction. It is said that the spacing between left and right ears (distance between both conchae) for adults is about 150 to 160 mm in average, and that for children is 120 to 130 mm. If the distance is made to be longer than 200 mm, the speaker apparatus will be become larger in size, and the portability, in which this apparatus can be held within the palm of the hand, will be lost. Further if the center-to-center distance between the right and left speaker units is made to be more than 200 mm, for example, 300 mm or more, such a speaker apparatus is not heard at a far distance from the speaker, but at the central portion thereof. When a high frequency sound is emitted in such a state, the directivity becomes high, a high-pitched sound is omitted and it becomes difficult to obtain good tone quality.

The acoustic circuit configuration for the speaker apparatus described above will be described.

Figure 8:
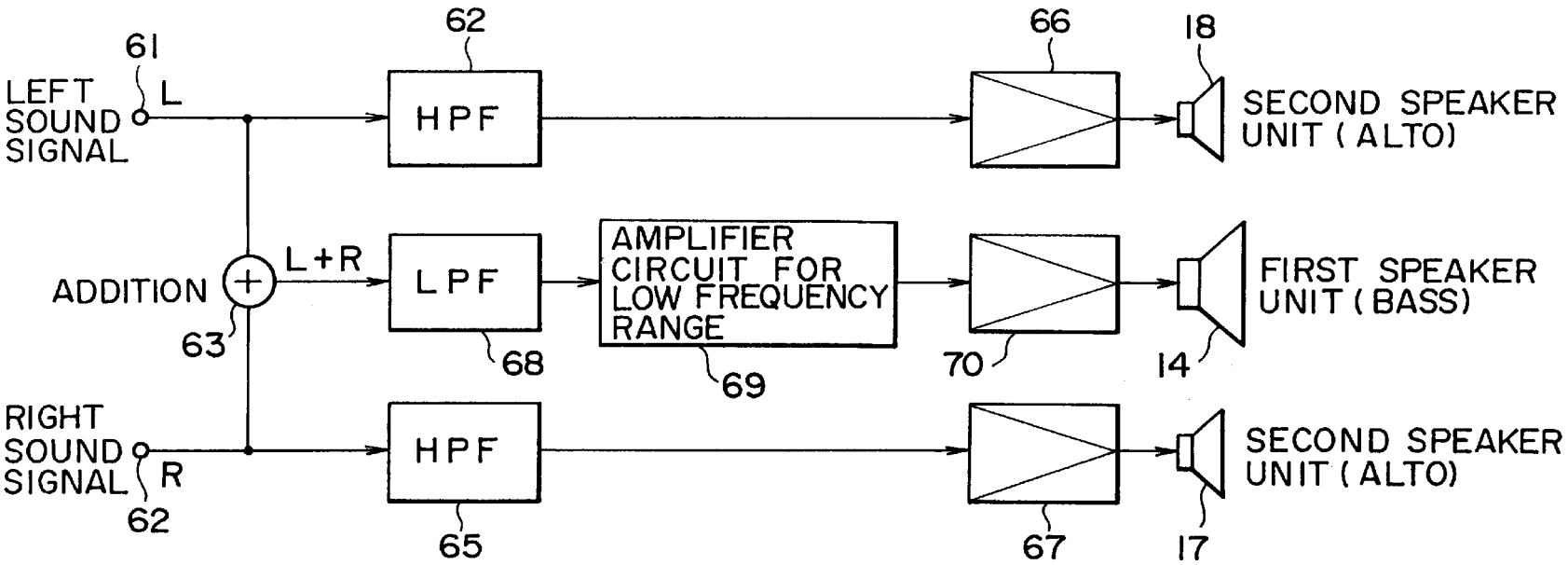
FIG. 8 is a circuit diagram showing a circuit configuration for a speaker apparatus according to the present invention.

This speaker apparatus has first and second input terminals 61 and 62 in which audio signals for left channel and audio signals for right channel are inputted respectively as shown in FIG. 8, and the left audio signals in a stereo inputted through the first input terminal 61 are supplied to a first high-pass filter (hereinafter, referred to as HPF) 62 and an adder 63. The right audio signals inputted through the second input terminal 62 are supplied to the adder 63 and a second HPF 65.

Figure 9:
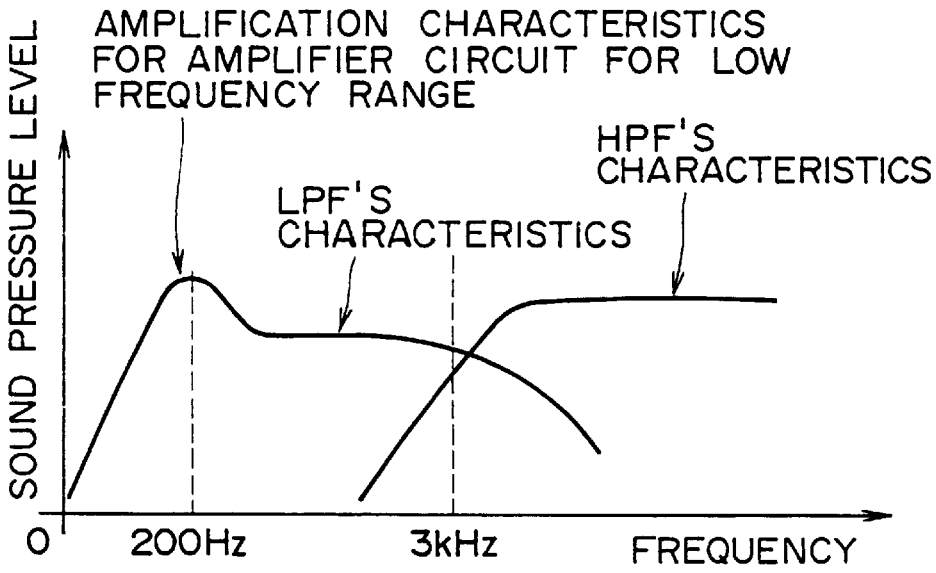
FIG. 9 is a characteristic diagram showing the sound pressure frequency characteristics of a speaker apparatus according to the present invention.

The first and second HPF 62 and 65 have characteristics to allow signals of not lower than 3 kHz as shown in, for example, FIG. 9 to pass, and allow middle and high frequency components of not lower than 3 kHz of the respective audio signals to pass, thus supplying the audio signals of middle and high frequency obtained to first and second amplifiers 66 and 67. The audio signals from the amplifiers 66 and 67 drive the speaker units 17 and 18. In this respect, the pair of speaker units 17 and 18 are adapted to be able to reproduce the frequency from a sound range not lower than about 3 kHz to about 20 kHz.

On the other hand, the adder 63 adds the left audio signals inputted through the first input terminal 61 and the right audio signals inputted through the second input terminal 62, and supplies audio signals obtained by composing the left and right audio signals to a low-pass filter (hereinafter, referred to as LPF) 68.

The LPF 68 has characteristics to allow signals of not higher than 3 kHz as shown in FIG. 9 to pass, and allows the low frequency component of not higher than 3 kHz of the audio signals supplied from the adder 63 to pass, thus supplying the audio signals of low frequency obtained to a low frequency intensifying circuit 69.

The low frequency intensifying circuit 69 is used to intensify the low frequency component of about 150 Hz to 250 Hz, and in this embodiment, has characteristics to intensify the low frequency component near 200 Hz as shown in FIG. 9. Audio signals from the low frequency intensifying circuit 69 are supplied to a third amplifier 70 to drive the first speaker unit 14 with output from the amplifier 70.

In this respect, the low frequency intensifying circuit 69 is interposed in the first speaker unit 14 to intensify the component of about 150 Hz to 250 Hz. In this embodiment, the cabinet 11 employs the back face open type speaker configuration for the speaker unit 14. This back face open type speaker has merits that air resistance in the cabinet 11 decreases, the speaker unit 14 has better response, and the articulation is improved. However, the sound emitted from the back face through-holes 19 of the speaker unit 11 goes round to the front to interfere with the reproduced sound emitted from the front, and as a result, the low-pitched sound becomes insufficient as compared with the enclosed type speaker configuration. In particular, the low frequency level of not higher than about 500 noticeably lowers in a speaker apparatus which has been miniaturized to make it portable. Therefore, the low-pitched sound of not higher than about 500 Hz is supplemented in view of the circuit by intensifying by about 150 Hz to 250 Hz by means of the low frequency intensifying circuit 69. Thus, the listener can listen to sound (music) which the listener does not feel any lowering in the low frequency level even if the volume is turned down.

Figure 10:
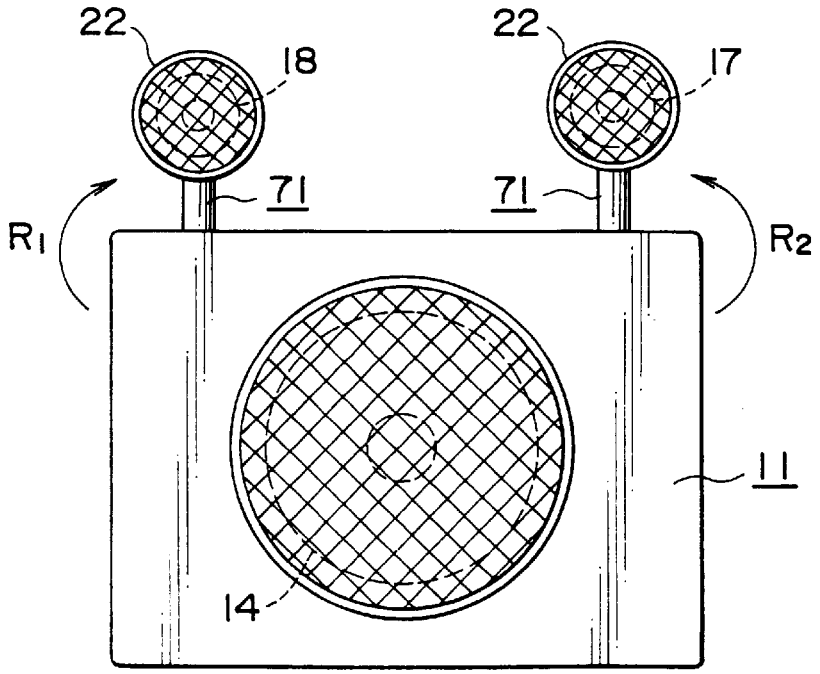
FIG. 10 is a front view showing another example of a speaker apparatus according to the present invention.

In the above-described speaker apparatus, the supporting members 20 and 20 for supporting the pair of the second speaker units 17 and 18 are supported so as to rotate in a direction indicated by P as shown in FIG. 7 with respect to the cabinet 11. However, as shown in FIG. 10, it may be possible to support supporting members 71 and 71 for supporting a pair of second speaker units 17 and 18 by rotating them in directions indicated by arrows $R_1$ and $R_2$ in FIG. 10 in parallel to the front of the cabinet 11. In the case of this example, when the supporting members 71 and 71 are rotated on the cabinet 11 side, which is opposite to the direction indicated by arrow $R_1$ or arrow $R_2$, and are placed in the second position, the second speaker units 17 and 18 are housed in a housing concave portion provided on the back side of the cabinet 11, and go into a state in which they are at least superposed on the cabinet 11.

Figure 11:
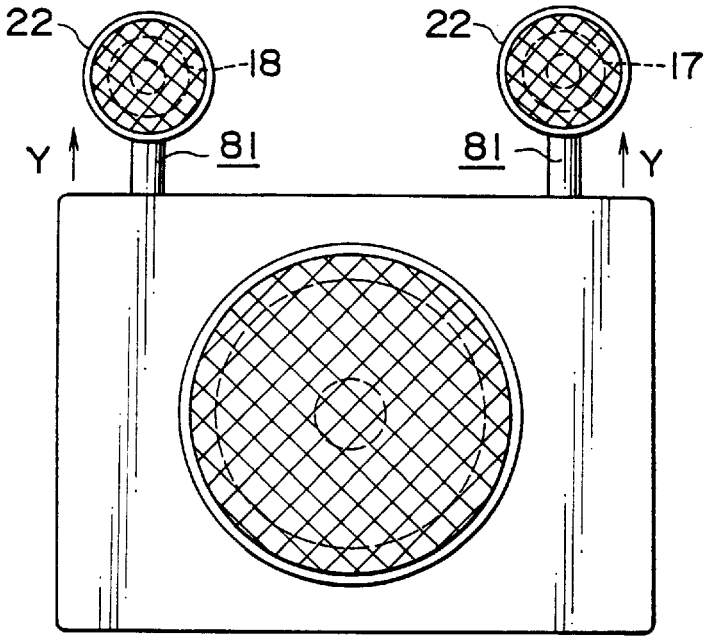
FIG. 11 is a front view showing further another example of a speaker unit according to the present invention.
Figure 12:
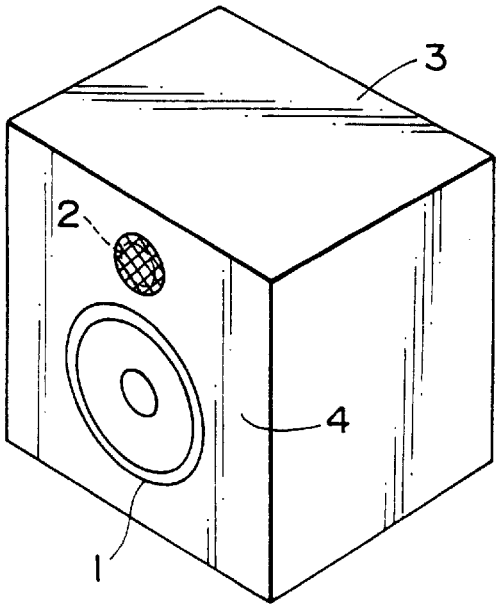
FIG. 12 is a perspective view showing a conventional speaker apparatus.

Further, it may be possible to slide supporting members 81 and 81 for supporting the second speaker units 17 and 18 on the top side of the cabinet 11 in a direction indicated an arrow Y for projecting and supporting as shown in FIG. 11.

In this case, by sliding the supporting members 81 and 81 in a vertical direction, it is possible to move the second speaker units 17 and 18 between the first position, where they project from the cabinet 11, and the second position, where a housing concave portion is provided within the cabinet 11 and they are caused to slide in a direction opposite to the direction indicated by the mark Y to be housed in the housing concave portion.

As described above, in a speaker apparatus according to the present invention, the second speaker units projecting from the cabinet can be housed on the cabinet side, and therefore, it is possible to miniaturize the entire apparatus, thus becoming an excellent one easy to carry. Also, since the second speaker units can be spaced apart from the cabinet to be arranged in the air during the use, it is possible to prevent an adverse effect due to reflected wave, to have good sound pressure frequency characteristics and to realize sound reproduction excellent in presence.

What is claimed is:

1. A speaker apparatus, comprising:

a cabinet having a woofer unit installed therein for reproducing a low frequency range and including first and second concave recessed portions formed on a back side thereof;

first and second speakers for reproducing frequencies higher than said low frequency range and adapted to respectively fit on said first and second concave recessed portions formed on said back side of said cabinet; and first and second elongated supporting members for supporting said first and second speakers on respective distal ends thereof, wherein said first and second elongated supporting members are rotatable supported on respective proximal ends thereof by said cabinet so that each of said first and second speakers rotate between a first position where said speaker projects away from said cabinet and a second position where said speaker is housed on one of said first and second concave portions formed on said back side of said cabinet; and a spacing between said first and second speakers is selected to be fixed in the range between 120 mm and 200 mm, when said first and second speakers are rotated to said first position.

2. The speaker apparatus as defined in claim 1, wherein said cabinet is provided with a foldable leg member for supporting said cabinet on a surface.

3. The speaker apparatus according to claim 1, further comprising:

means for adding said low frequency range of left and right channels being fed thereto and producing a combined low frequency signal; and means for feeding said combined low frequency signal to said woofer unit installed in said cabinet.

4. The speaker apparatus according to claim 1, further comprising means for securely holding said first and second speakers at said first and second positions.

* * * * *